US009922594B2

(12) United States Patent
Kwon

(10) Patent No.: US 9,922,594 B2
(45) Date of Patent: Mar. 20, 2018

(54) ORGANIC LIGHT EMITTING DIODE (OLED) DISPLAY DEVICE

(71) Applicant: Samsung Display Co., Ltd., Yongin, Gyeonggi-do (KR)

(72) Inventor: Sun-Ja Kwon, Gunpo-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 493 days.

(21) Appl. No.: 14/470,023

(22) Filed: Aug. 27, 2014

(65) Prior Publication Data

US 2015/0170564 A1 Jun. 18, 2015

(30) Foreign Application Priority Data

Dec. 13, 2013 (KR) ..... 10-2013-0155826

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2300/0426* (2013.01); *G09G 2300/0452* (2013.01); *G09G 2310/0297* (2013.01); *G09G 2320/0209* (2013.01); *G09G 2330/06* (2013.01)

(58) Field of Classification Search
CPC ..... G09G 2310/0297; G09G 3/3275
See application file for complete search history.

(56) References Cited

U.S. PATENT DOCUMENTS

| | | | | |
|---|---|---|---|---|
| 6,097,362 | A | 8/2000 | Kim | |
| 2002/0084971 | A1 | 7/2002 | Youn | |
| 2004/0263506 | A1* | 12/2004 | Koyama | G09G 3/3225 345/204 |
| 2006/0107146 | A1* | 5/2006 | Kim | G09G 3/3233 714/727 |
| 2006/0139255 | A1 | 6/2006 | Kim et al. | |

FOREIGN PATENT DOCUMENTS

| | | | |
|---|---|---|---|
| KR | 10-1999-0031752 | A | 5/1999 |
| KR | 10-2002-0056092 | A | 7/2002 |
| KR | 10-2005-0003753 | A | 1/2005 |
| KR | 10-2006-0032829 | A | 4/2006 |
| KR | 10-2007-0035297 | A | 3/2007 |

* cited by examiner

*Primary Examiner* — Amare Mengistu
*Assistant Examiner* — Shawna Stepp Jones
(74) *Attorney, Agent, or Firm* — Knobbe Martens Olson & Bear LLP

(57) ABSTRACT

An organic light emitting diode display device having a demultiplexing structure is disclosed. One inventive aspect includes a display panel, a scan driver, a data driver, a plurality of demultiplexers and a timing controller. The timing controller includes first, second and third control signal lines. Each demultiplexer includes first, second and third switching elements, and a branch point formed between the control signal lines and the switching elements. The distance between the switching elements and the display panel is less than the distance between the control signal lines and the display panel.

21 Claims, 10 Drawing Sheets

100

100

ORGANIC LIGHT EMITTING DIODE (OLED) DISPLAY DEVICE

CROSS-REFERENCE TO RELATED APPLICATIONS

This application claims priority under 35 U.S.C. § 119 to Korean patent Application No. 2013-0155826 filed on Dec. 13, 2013, the disclosure of which is hereby incorporated by reference herein in its entirety.

BACKGROUND

Field

The described technology generally relates to an organic light emitting diode (OLED) display device having a demultiplexing structure.

Description of the Related Technology

Recently, an organic light emitting diode (OLED) display device is widely used as a flat panel display included in an electronic device because the OLED display device has advantages of small size (i.e., thinner and lighter), low power consumption, high luminance, fast response speed, etc. Generally, in an OLED display device, a plurality of pixels are coupled to a plurality of data-lines for transmitting a data signal to the pixels, and to a plurality of scan-lines for transmitting a scan signal to the pixels. In addition, the pixels are arranged at locations corresponding to crossing points of the data-lines and the scan-lines. Thus, increasing the quantity of the pixels for increasing the resolution of the organic light emitting diode display device may result in increasing a quantity of the data-lines and/or a quantity of the scan-lines.

To solve these problems, an OLED display device having a demultiplexing structure has been suggested. Specifically, the OLED display device having the demultiplexing structure may include a demultiplexing unit having a plurality of demultiplexers. Here, the demultiplexing unit may be placed between the display panel and the data driving unit in the OLED display device. During one horizontal period (1H), the demultiplexers of the demultiplexing unit sequentially receive a plurality of data signals output from the data driving unit. The demultiplexers then selectively apply the data signals to the pixels according to colors of lights emitted by the pixels.

In one exemplary implementation, during one horizontal period (1H), the demultiplexers sequentially receive a red color data signal (i.e., a data signal related to a red color light), a green color data signal (i.e., a data signal related to a green color light), and a blue color data signal (i.e., a data signal related to a blue color light). The demultiplexers then selectively apply the red color data signal, the green color data signal, and the blue color data signal to red color pixels (i.e., the pixels emitting the red color light), green color pixels (i.e., the pixels emitting the green color light), and blue color pixels (i.e., the pixels emitting the blue color light).

However, because control signal lines of a timing control unit and data lines of the data driving unit cross each other in a conventional electric wiring structure of the demuliplexer, unnecessary overlap capacitance may occur and a vertical line blur may appear on the display panel.

SUMMARY OF CERTAIN INVENTIVE ASPECTS

One inventive aspect of the disclosed technology is an organic light emitting diode display device including a demultiplexer capable of reducing unnecessary overlap capacitance.

According to one aspect of the disclosed technology, an organic light emitting diode display device having a demultiplexing structure includes a display panel, a scan driving unit, a data driving unit, a demultiplexing unit including a plurality of demultiplexers including a plurality of demultiplexer, and a timing control unit. Each of the demultiplexers can include a first switching element, a second switching element, and a third switching element. The first switching element can include a first terminal that is coupled to a branch point of an output line of the data driving unit, a second terminal that is coupled to a first data line, and a gate terminal that is coupled to a first control signal line of the timing control unit. The second switching element can include a first terminal that is coupled to the branch point, a second terminal that is coupled to a second data line, and a gate terminal that is coupled to a second control signal line of the timing control unit. The third switching element can include a first terminal that is coupled to the branch point, a second terminal that is coupled to a third data line, and a gate terminal that is coupled to a third control signal line of the timing control unit. The first through third switching elements can be formed closer to the display panel than the first through third control signal lines, and the branch point can be formed between the first through third control signal lines and the first through third switching elements.

In exemplary embodiments, the first control signal line can be implemented by a first control signal electrode, the second control signal line can be implemented by a second control signal electrode, and the third control signal line can be implemented by a third control signal electrode.

In exemplary embodiments, the first data line can be implemented by a first data electrode, the second data line can be implemented by a second data electrode, and the third data line can be implemented by a third data electrode.

In exemplary embodiments, the branch point can be implemented by a distributed electrode, and the output line can be implemented by an output electrode.

In exemplary embodiments, the first through third switching elements can correspond to a p-channel metal oxide semiconductor (PMOS) transistor.

In exemplary embodiments, the first terminal can correspond to a source electrode, the second terminal can correspond to a drain electrode, and the gate terminal can correspond to a gate electrode.

In exemplary embodiments, the distributed electrode can be formed between the first through third control signal electrodes and the first through third switching elements, and the distributed electrode can be contacted with the output electrode.

In exemplary embodiments, the output electrode can be connected to the source electrodes of the first through third switching elements via the distributed electrode.

In exemplary embodiments, the drain electrode of the first switching element can be connected to the first data electrode, the drain electrode of the second switching element can be connected to the second data electrode, and the drain electrode of the third switching element can be connected to the third data electrode.

In exemplary embodiments, the gate electrode of the first switching element can be connected to the first control signal electrode, the gate electrode of the second switching element can be connected to the second control signal electrode, and the gate electrode of the third switching element can be connected to the third control signal electrode.

In exemplary embodiments, the display panel can be manufactured based on an RGB-OLED technology.

In exemplary embodiments, the first control signal that is applied to the first control signal electrode can control a switching operation of the first switching element, the second control signal that is applied to the second control signal electrode can control a switching operation of the second switching element, and the third control signal that is applied to the third control signal electrode can control a switching operation of the third switching element.

In exemplary embodiments, the first switching element can apply a red color data signal that is outputted at the data driving unit to a red color pixel of the display panel, the second switching element can apply a green color data signal that is outputted at the data driving unit to a green color pixel of the display panel, and the third switching element can apply a blue color data signal that is outputted at the data driving unit to a green color pixel of the display panel.

According to another aspect of the disclosed technology, an organic light emitting diode display device having a demultiplexing structure includes a display panel, a scan driving unit, a data driving unit, a demultiplexing unit including a plurality of demultiplexers including a plurality of demultiplexer, and a timing control unit. Each of the demultiplexers can include a first switching element, a second switching element, a third switching element, and fourth switching element. The first switching element can include a first terminal that is coupled to a first branch point of an output line of the data driving unit, a second terminal that is coupled to a first data line, and a gate terminal that is coupled to a first control signal line of the timing control unit. The second switching element can include a first terminal that is coupled to the first branch point, the second terminal that is coupled to a second data line, and the gate terminal that is coupled to a second control signal line of the timing control unit. The third switching element can include a first terminal that is coupled to a second branch point, a second terminal that is coupled to a third data line, and a gate terminal that is coupled to a third control signal line of the timing control unit. The fourth switching element can include a first terminal that is coupled to the first branch point, a second terminal that is coupled to a data line, and a gate terminal that is coupled to a fourth control signal line of the timing control unit. The first through fourth switching elements can be formed closer to the display panel than the first through fourth control signal lines, and the first and second branch point can be formed between the first through fourth control signal lines and the first through fourth switching elements.

In exemplary embodiments, the first control signal line can be implemented by a first control signal electrode, the second control signal line can be implemented by a second control signal electrode, the third control signal line can be implemented by a third control signal electrode, and the fourth control signal line can be implemented by a fourth control signal electrode.

In exemplary embodiments, the first data line can be implemented by a first data electrode, the second data line can be implemented by a second data electrode, the third data line can be implemented by a third data electrode, and the fourth data line can be implemented by a fourth data electrode.

In exemplary embodiments, the first and second branch points can be implemented by a distributed electrode, and the output line can be implemented by an output electrode.

In exemplary embodiments, the first through fourth switching elements can correspond to a p-channel metal oxide semiconductor transistor.

In exemplary embodiments, the first terminal can correspond to a source electrode, the second terminal can correspond to a drain electrode, and the gate terminal can correspond to a gate electrode.

In exemplary embodiments, the distributed electrode can be formed between the first through fourth control signal electrodes and the first through fourth switching elements, and the distributed electrode can be contacted with the output electrode.

In exemplary embodiments, the output electrode can be connected to the source electrodes of the first through fourth switching elements via the distributed electrode.

In exemplary embodiments, the drain electrode of the first switching element can be connected to the first data electrode, the drain electrode of the second switching element can be connected to the second data electrode, and the drain electrode of the third switching element can be connected to the third data electrode, and the drain electrode of the fourth switching element can be connected to the third data electrode.

In exemplary embodiments, the gate electrode of the first switching element can be connected to the first control signal electrode, the gate electrode of the second switching element can be connected to the second control signal electrode, and the gate electrode of the third switching element can be connected to the third control signal electrode, and the gate electrode of the fourth switching element can be connected to the fourth control signal electrode.

In exemplary embodiments, the display panel can be manufactured based on a WRGB-OLED technology.

In exemplary embodiments, the first control signal that is applied to the first control signal electrode can control a switching operation of the first switching element, the second control signal that is applied to the second control signal electrode can control a switching operation of the second switching element, and the third control signal that is applied to the third control signal electrode can control a switching operation of the third switching element, and the fourth control signal that is applied to the fourth control signal electrode can control a switching operation of the fourth switching element.

In exemplary embodiments, the first switching element can apply a red color data signal that is outputted at the data driving unit to a red color pixel of the display panel, the second switching element can apply a green color data signal that is outputted at the data driving unit to a green color pixel of the display panel, and the third switching element can apply a blue color data signal that is outputted at the data driving unit to a green color pixel of the display panel, and the fourth switching element can apply a white color data signal that is outputted at the data driving unit to a white color pixel of the display panel.

Therefore, an organic light emitting diode display device according to exemplary embodiments can reduce an unnecessary overlap capacitance because a demultiplexer included in the organic light emitting diode display device includes switching elements that are formed closer to a display panel than control signal lines and a branch point that is formed between the control signal lines and the switching elements.

BRIEF DESCRIPTION OF THE DRAWINGS

Exemplary embodiments can be understood in more detail from the following description taken in conjunction with the accompanying drawings.

DETAILED DESCRIPTION OF CERTAIN INVENTIVE EMBODIMENTS

Figure 1:
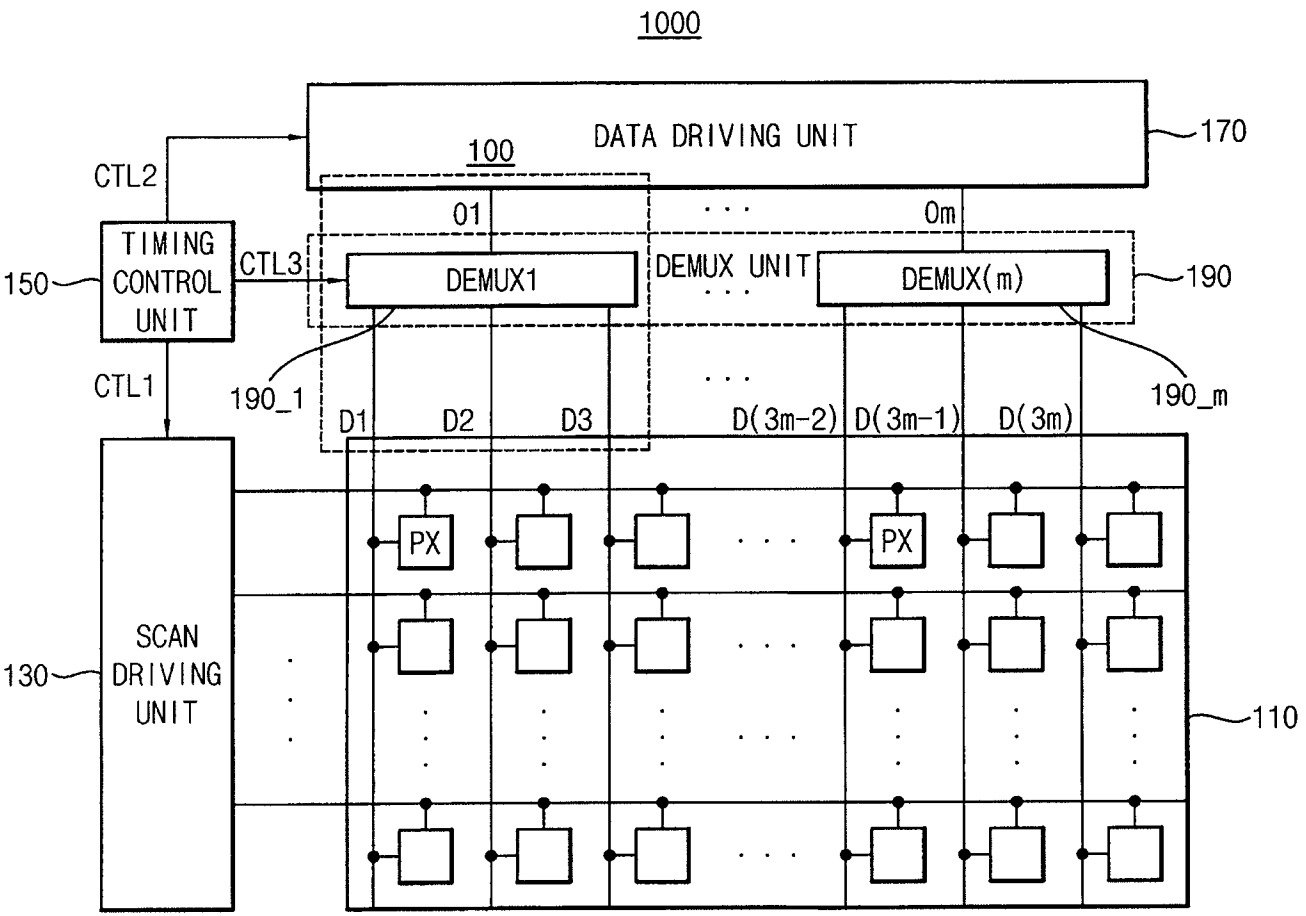
FIG. 1 is a block diagram illustrating an organic light emitting diode display device in accordance with exemplary embodiments.

Hereinafter, exemplary embodiments of the invention will be described in detail with reference to the accompanying drawings. In the drawings, identical or similar reference numerals may represent identical or similar elements.

Figure 2:
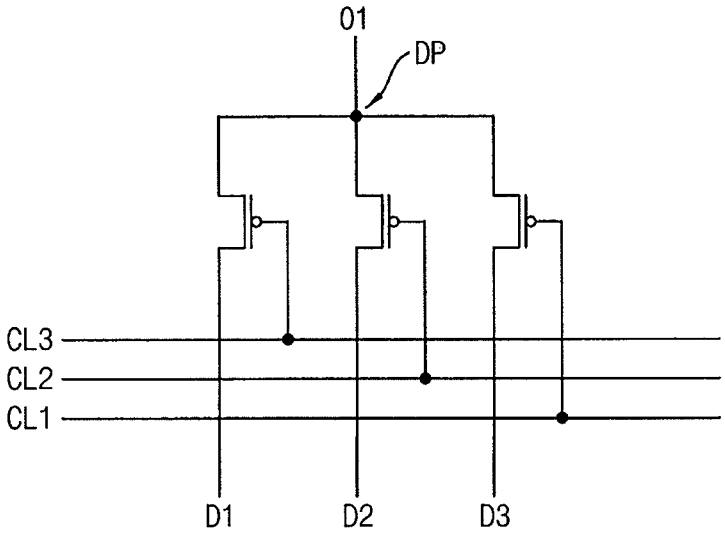
FIG. 2 is a diagram illustrating a conventional demultiplexer included in a demultiplexing unit of an organic light emitting diode display device.
Figure 3:
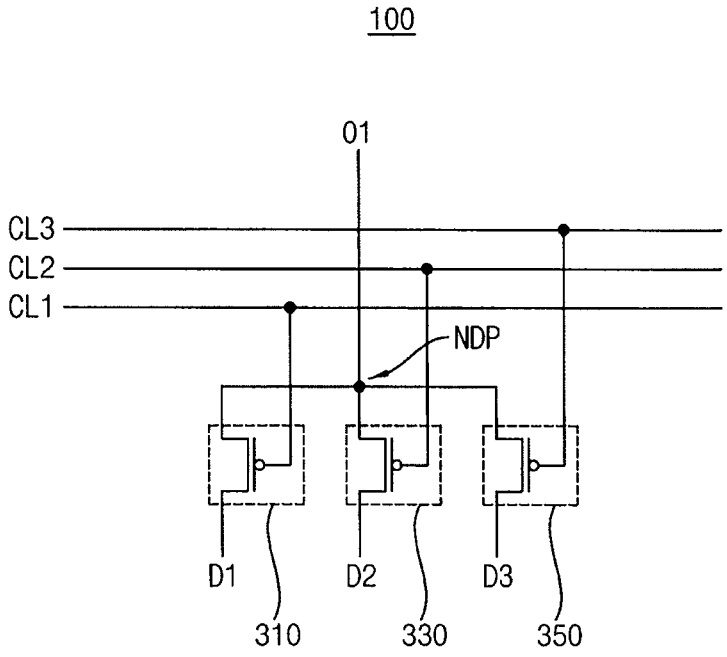
FIG. 3 is a diagram illustrating a demultiplexer included in a demultiplexing unit of the organic light emitting diode display device of FIG. 1.

FIG. 1 is a block diagram illustrating an organic light emitting diode display device in accordance with exemplary embodiments. FIG. 2 is a diagram illustrating a conventional demultiplexer included in a demultiplexing unit of an organic light emitting diode display device. FIG. 3 is a diagram illustrating a demultiplexer included in a demultiplexing unit of the organic light emitting diode display device of FIG. 1.

Referring to FIG. 1, the organic light emitting diode display (OLED) device 1000 includes a display panel 110, a scan driving unit or a scan driver 130, a data driving unit or a data driver 170, a demultiplexing unit 190, and a timing control unit or a timing controller 150.

The display panel 110 include a plurality of pixels. The pixels are arranged at locations corresponding to crossing points of scan-lines SL and data-lines D1-D(3*m*). In an exemplary embodiment, the display panel 110 is manufactured based on an RGB-OLED technology. In one exemplary implementation, a first data signal is applied to the first data line D1 and referred to as a red color data signal. Pixels are connected to the first data line D1 and may be referred to as red color pixels. A second data signal is applied to the second data line D2 and may be referred to as a green color data signal. Pixels that are connected to the second data line D2 may be referred to as green color pixels. A third data signal is applied to the third data line D3 and may be referred to as a blue color data signal. Pixels are connected to the third data line D3 and may be referred to as blue color pixels. However, the present inventive aspect is not limited thereto. In one exemplary implementation, according to required conditions for the organic light emitting diode display device 1000, respective color lights emitted by the pixels can be selected among the red color light, the green color light, and the blue color light in various ways.

The scan driving unit 130 may sequentially output a scan signal to the display panel 110 in response to a first signal CTL1 of the timing control unit 150. In one exemplary implementation, when the scan signal is outputted to a first scan line SL, the data signals are applied to the pixels that are coupled to the first scan line SL, respectively. In addition, when the scan signal is outputted to a second scan line SL, the data signals are applied to the pixels that are coupled to the second scan line SL, respectively.

The data driving unit 170 may selectively generate first through third data signals in response to a second signal CTL2 of the timing control unit 150. The selected signal may be transmitted to demultiplexers 190-1 through 190-m via output lines O1 through Om that are coupled to the demultiplexing unit 190. Depending on operations of the demultiplexing unit 190 based on the second signal CTL2 of the timing control unit 150, the data driver 170 selectively applies the first through third data signals to the display panel 110 via the demultiplexing unit 190. In one exemplary implementation, the first data signal corresponds to a signal that is related to the red color pixels emitting the red color light. The second data signal correspond to a signal that is related to the green color pixels emitting that green color light. The third data signal corresponds to a signal that is related to the blue color pixels emitting the blue color light.

The timing control unit 150 may control the scan driving unit 130, the data driving unit 170, and the demultiplexing unit 190. As illustrated in FIG. 1, the timing control unit 150 generates a first signal CTL1, a second signal CTL2, and a third signal CTL3. Here, the timing control unit 150 controls the scan driving unit 130, the data driving unit 170, and the demultiplexing unit 190 by providing the first signal CTL1, the second signal CTL2, and the third signal CTL3 to the scan driving unit 130, the data driving unit 170, and the demultiplexing unit 190, respectively. Specifically, the timing control unit 150 provides the first signal CTL1 to the scan driving unit 130. Thus, the scan driving unit 130 can sequentially output the scan signal to the display panel 110. In addition, the timing control unit 150 provides the second signal CTL2 to the data driving unit 170. Thus, the data driving unit 170 outputs the respective data signals corresponding to the pixels of the display panel 110.

Further, the timing control unit 150 can provide the third signal CTL3 to the demultiplexing unit 190. In this case, the demultiplexing unit 190 provides the first through third data signals. To this end, the third signal CTL3 may include the first through third control signals.

As illustrated in FIG. 1, the organic light emitting diode display device 1000 has a demultiplexing structure. Thus, the demultiplexing unit 190 can be placed between the display panel 110 and the data driving unit 170. The demultiplexing unit 190 includes a plurality of demultiplexers 190-1 through 190-m. The demultiplexing unit 190 may alternately apply the first through third data signals to the pixels. The first through third data signals are alternately outputted from the data driving unit 170.

Referring to FIG. 2, the conventional demultiplexer is shown. The conventional demultiplexer includes the output line O1 of the data driving unit 170. The output line O1 can be divided into three lines by a branch point DP. The three lines may be coupled (e.g., connected) to respective source terminals of switching elements. The respective drain terminals of the switching elements are coupled to the first through third data lines D1-D3. In addition, respective gate terminals of the switching elements may be coupled to the first through third control signal lines CL1-CL3 of the timing control unit 150. In this case, an overlap capacitance can be generated between the first through third control signal lines CL1-CL3, and the first through third data lines D1-D3 (e.g., a region overlapping the control signal lines CL1-CL3 and the data lines D1-D3). Because an unnecessary overlap capacitance occurs, a vertical line blur may appear on the display panel.

Referring to FIG. 3, a demultiplexer 100 included in the organic light emitting diode display device 1000 is shown. The demultiplexer 100 includes a first switching element 310, a second switching element 330, and a third switching element 350.

A first terminal of the first switching element 310 is coupled to a branch point NDP of the output line O1 of the data driving unit 170. In addition, a second terminal of the first switching element 310 is coupled to the first data line D1. Further, a gate terminal of the first switching element 310 is coupled to the first control signal line CL1 of the timing control unit 150.

A first terminal of the second switching element 330 is coupled to the branch point NDP. A second terminal of the second switching element 330 is coupled to the second data line D2. A gate terminal of the second switching element 330 is coupled to the second control signal line CL2 of the timing control unit 150.

A first terminal of the third switching element 350 is coupled to the branch point NDP. A second terminal of the third switching element 350 is coupled to the third data line D3. A gate terminal of the third switching element 350 is coupled to the third control signal line CL3 of the timing control unit 150.

The first through third switching elements 310, 330, and 350 may be formed closer to the display panel 110 than the first through third control signal lines CL1-CL3. The branch point NDP may be formed between the first through third control signal lines CL1-CL3 and the first through third switching elements 310, 330, and 350.

In one exemplary implementation, at least one of the first, second or third data lines D1-D3 does not cross over or overlap the first, second and third control signal lines CL1-CL3. In another exemplary implementation, all the first, second and third data lines D1-D3 do not cross over or overlap the first, second and third control signal lines CL1-CL3.

In this case, because the first through third data lines D1-D3 are not formed over the first through third control signal lines CL1-CL3, an overlap capacitance of the demultiplexer 100 can be reduced compared to an overlap capacitance of the conventional demultiplexer of FIG. 2.

Figure 4:
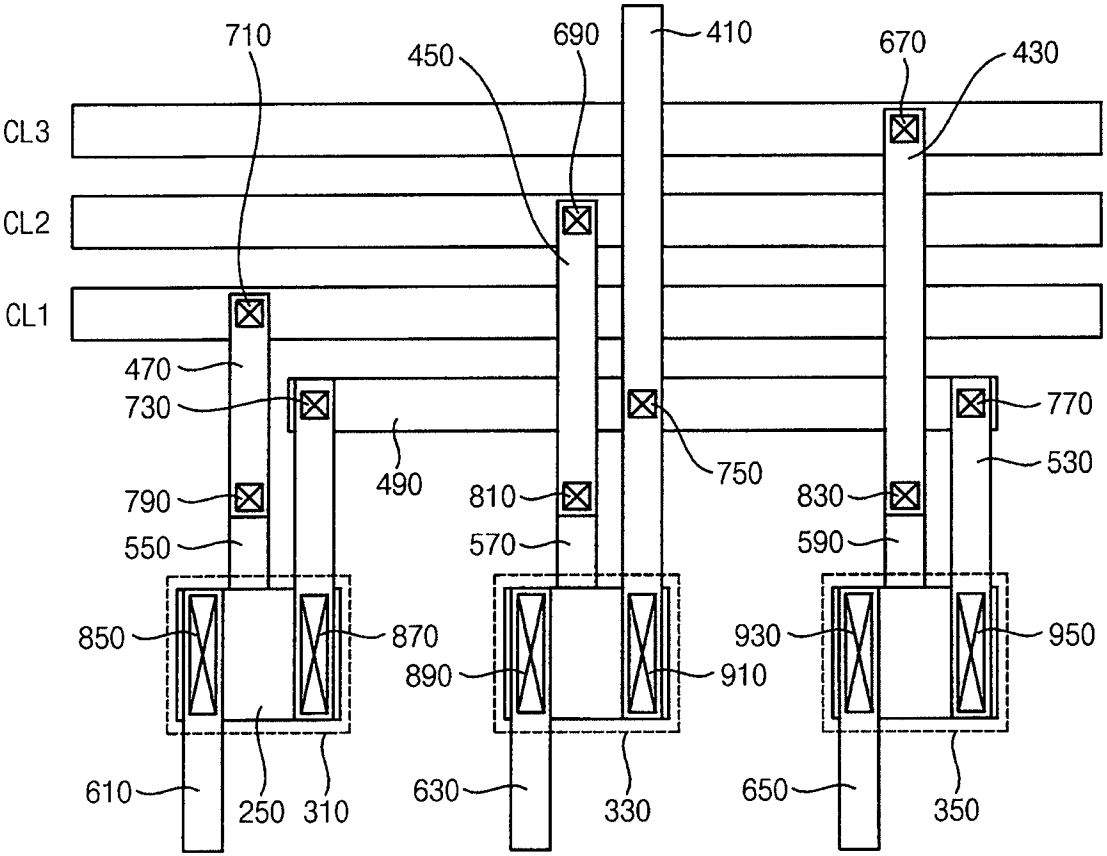
FIGS. 4 and 5 are plane views illustrating the demultiplexer of FIG. 3.
Figure 5:
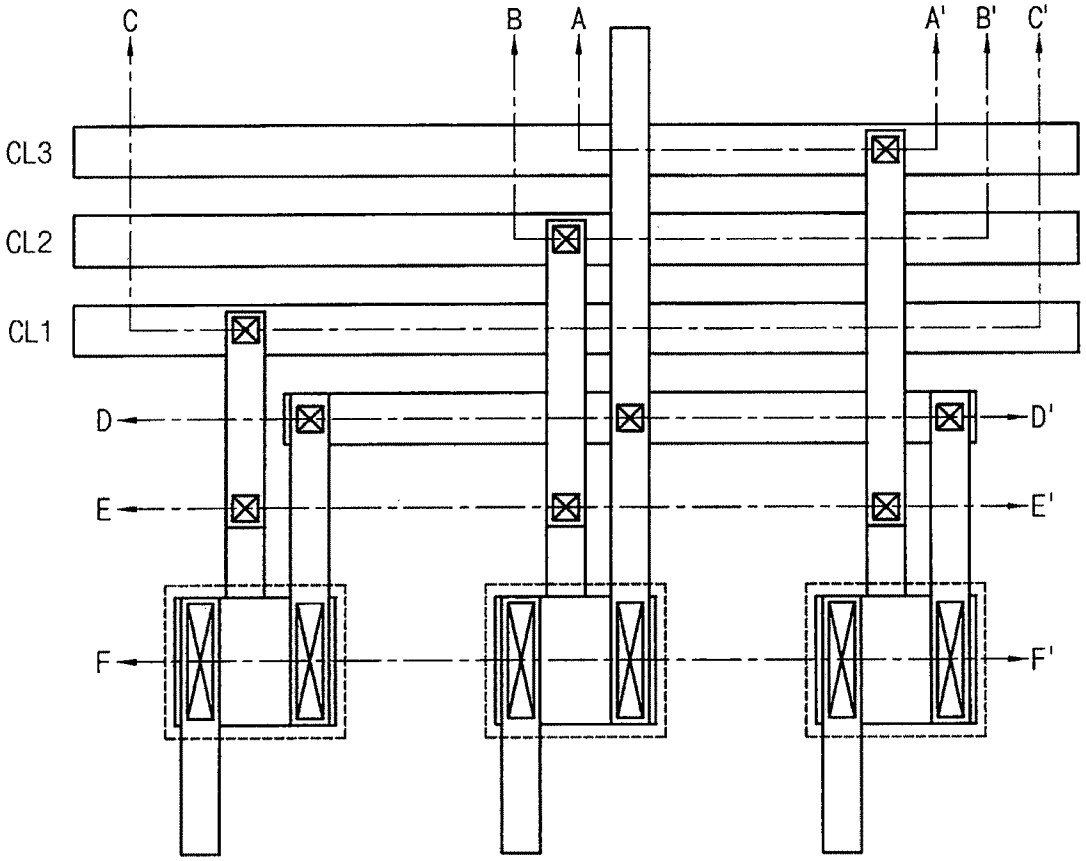

FIGS. 4 and 5 are plane views illustrating the demultiplexer of FIG. 3.

Referring to FIGS. 4, and 5, the first control signal line CL1 is implemented by or comprises a first control signal electrode CL1. The second control signal line CL2 is implemented by or comprises a second control signal electrode CL2. The third control signal line CL3 is implemented by or comprises a third control signal electrode CL3. The first data line D1 is implemented by or comprises a first data electrode 610. The second data line D2 is implemented by or comprises a second data electrode 630. The third data line D3 is implemented by or comprises a third data electrode 650. The branch point NDP is implemented by or comprises a distributed electrode 490. The output line O1 is implemented by or comprises an output electrode 410. In an exemplary embodiment, the first through third switching elements 310, 330, and 350 correspond to p-channel metal oxide semiconductor (PMOS) transistors. In addition, the first terminal may correspond to a source electrode, the second terminal may correspond to a drain electrode, and the gate terminal may correspond to a gate electrode.

As illustrated in FIGS. 1, 3, and 4, the demultiplexer 100 includes the output electrode 410, a first electrode 430, a second electrode 450, a third electrode 470, a fourth electrode 510, a fifth electrode 530, a sixth electrode 550, a seventh electrode 570, a eighth electrode 590, the distributed electrode 490, the first switching element 310, the second switching element 330, the third switching element 350, the first data electrode 610, the second data electrode 630, and the third data electrode 650.

The output electrode 410 is formed on a portion of the first through third control signal electrodes CL1-CL3, a portion of the distributed electrode 490, and a portion of the second switching element 330. In addition, the output electrode 410 is coupled to the distributed electrode 490 via a fifth contact hole 750. Further, the output electrode 410 and a second active electrode 280 of the second switching element 330 are coupled via a (13)th contact hole 910. The output electrode 410 corresponds to a source electrode of the second switching element 330. The output electrode 410 transmits a data signal of the data driving unit 170 to the distributed electrode 490 through the fifth contact hole 750.

The distributed electrode 490 is formed between the first through third control signal electrodes CL1-CL3 and the first through third switching elements 310, 330, and 350. In addition, the distributed electrode 490 is coupled to the output electrode 410 via the fifth contact hole 750. Further, the distributed electrode 490 is coupled to the fourth electrode 510 via a fourth contact hole 730. The distributed electrode 490 is coupled to the fifth electrode 530 via a sixth contact hole 770. As described above, the data signal that is outputted from the data driving unit 170 may be transmitted from the output electrode 410 to the fourth electrode 510 through the distributed electrode 490. Also, the data signal may be transmitted from the output electrode 410 to the fifth electrode 530 through the distributed electrode 490.

The first switching element 310, the second switching element 330, and third switching element 350 are formed between the distributed electrode 490 and the display panel 110.

The first switching element 310 includes a gate electrode, an active layer, a source electrode, and a drain electrode. The gate electrode of the first switching element 310 corresponds to the sixth electrode 550. The source electrode of the first switching element 310 corresponds to the fourth electrode 510. In addition, the drain electrode of the first switching element 310 corresponds to the first data electrode 610. The active layer of the first switching element 310 corresponds to a first active electrode 270. The sixth electrode 550 is coupled to the third electrode 470 via a seventh contact hole 790. The third electrode 470 is coupled to the first control signal electrode CL1 via a third contact hole 710. Thus, the sixth electrode 550 may receive the first control signal. The fourth electrode 510 is coupled to the first active electrode 270 via an (11)th contact hole 870. The fourth electrode 510 is coupled to the distributed electrode 490 via the fourth contact hole 730. The distributed electrode 490 is coupled to the output electrode 410 via the fifth contact hole 750. Thus, the fourth electrode 510 may receive the data signal of the data driving unit 170. The first data electrode 610 may be coupled to the first active electrode 270 via a (10)th contact hole 850. Accordingly, the first control signal that is applied to the sixth electrode 550 may control a data signal that is applied to the fourth electrode 510. The data signal may be transmitted to the pixels of the display panel 110 by passing through the first data electrode 610.

The second switching element 330 includes a gate electrode, an active layer, a source electrode, and a drain electrode. The gate electrode of the second switching element 330 corresponds to the seventh electrode 570. The source electrode of the second switching element 330 corresponds to the output electrode 410. In addition, the drain electrode of the second switching element 330 corresponds to the second data electrode 630. The active layer of the second switching element 330 corresponds to a second active electrode 280. The seventh electrode 570 is coupled to the second electrode 450 via an eighth contact hole 810. The second electrode 450 is coupled to the second control signal electrode CL2 via a second contact hole 690. Thus, the seventh electrode 570 receives the second control signal. The output electrode 410 is coupled to the second active electrode 280 via the (13)th contact hole 910. Thus, the output electrode 410 may receive the data signal that is outputted from data driving unit 170. The second data electrode 630 is coupled to the second active electrode 280 via a (12)th contact hole 890. Accordingly, the second control signal that is applied to the seventh electrode 570 may control a data signal that is applied to the output electrode 410. The data signal may be transmitted to the pixels of the display panel 110 by passing through the second data electrode 630.

The third switching element 350 includes a gate electrode, an active layer, a source electrode, and a drain electrode. The gate electrode of the third switching element 350 corresponds to the eighth electrode 590. The source electrode of the third switching element 350 corresponds to the fifth electrode 530. In addition, the drain electrode of the third switching element 350 corresponds to the third data electrode 650. The active layer of the third switching element 350 may correspond to a third active electrode 290. The eighth electrode 590 is coupled to the first electrode 430 via a ninth contact hole 830. The first electrode 430 is coupled to the third control signal electrode CL3 via a first contact hole 670. Thus, the eighth electrode 590 may receive the third control signal. The fifth electrode 530 is coupled to the third active electrode 290 via a (15)th contact hole 950. The fifth electrode 530 is coupled to the distributed electrode 490 via the sixth contact hole 770. The distributed electrode 490 is coupled to the output electrode 410 via the fifth contact hole 750. Thus, the fifth electrode 530 receives the data signal of the data driving unit 170. The third data electrode 650 is coupled to the third active electrode 290 via a (14)th contact hole 930. Accordingly, the third control signal that is applied to the sixth electrode 550 may control a data signal that is applied to the fifth electrode 530. The data signal may be transmitted to the pixels of the display panel 110 by passing through the third data electrode 650.

As described above, an overlap capacitance of the demultiplexer 100 may be reduced because the distributed electrode 490 and the first through third switching elements 310, 330, and 350 may be formed between the first through third control signal electrodes CL1-CL3 and the display panel 110. As a result, an image quality of the display panel 110 can be improved.

Figure 6:
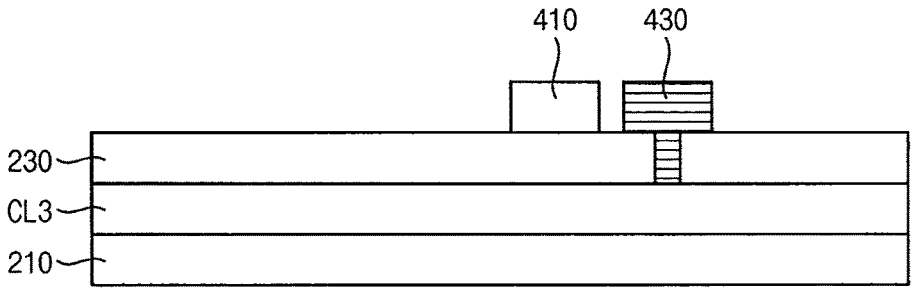
FIG. 6 is a cross-sectional view taken along a line A-A' of FIG. 5.

FIG. 6 is a cross-sectional view taken along a line A-A' of FIG. 5.

Referring to FIGS. 4 through 6, the third control signal electrode CL3 is formed on a substrate 210. An insulating layer 230 may be formed on the third control signal electrode CL3. The output electrode 410 and the first electrode 430 may be formed on the insulating layer 230. Here, the first electrode 430 contacts the third control signal electrode CL3 via the first contact hole 670.

Figure 7:
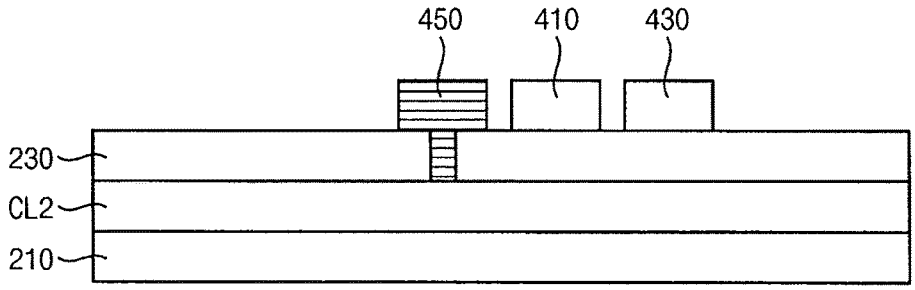
FIG. 7 is a cross-sectional view taken along a line B-B' of FIG. 5.

FIG. 7 is a cross-sectional view taken along a line B-B' of FIG. 5.

Referring to FIGS. 4, 5, and 7, the second control signal electrode CL2 is formed on the substrate 210. The insulating layer 230 may be formed on the second control signal electrode CL2. The second electrode 450, the output electrode 410, and the first electrode 430 may be formed on the insulating layer 230. Here, the second electrode 450 contacts the second control signal electrode CL2 via the second contact hole 690.

Figure 8:
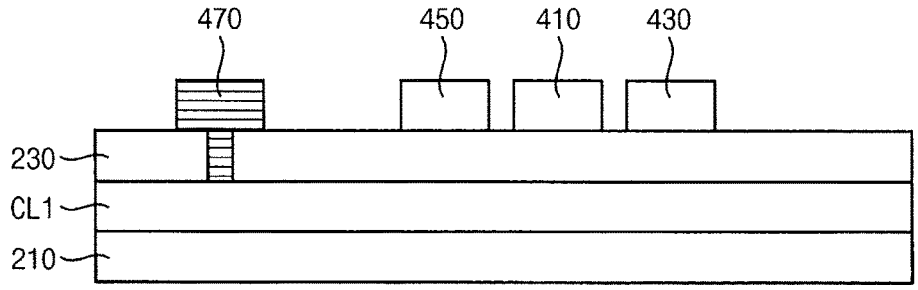
FIG. 8 is a cross-sectional view taken along a line C-C' of FIG. 5.

FIG. 8 is a cross-sectional view taken along a line C-C' of FIG. 5.

Referring to FIGS. 4, 5, and 8, the first control signal electrode CL1 is formed on the substrate 210. The insulating layer 230 may be formed on the first control signal electrode CL2. The third electrode 470, the second electrode 450, the output electrode 410, and the first electrode 430 may be formed on the insulating layer 230. Here, the third electrode 470 contacts the first control signal electrode CL1 via the third contact hole 710.

Figure 9:
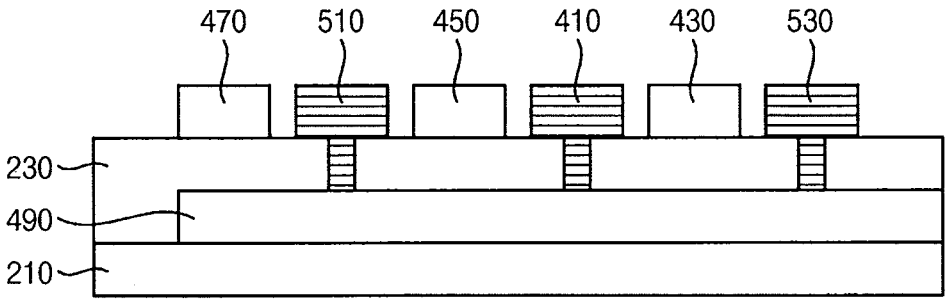
FIG. 9 is a cross-sectional view taken along a line D-D' of FIG. 5.

FIG. 9 is a cross-sectional view taken along a line D-D' of FIG. 5.

Referring to FIGS. 4, 5, and 9, the distributed electrode 490 is formed on the substrate 210. The insulating layer 230 may be formed on the distributed electrode 490. The insulating layer 230 may cover the distributed electrode 490. The third electrode 470, the fourth electrode 510, the second electrode 450, the output electrode 410, the first electrode 430, and the fifth electrode 530 may be formed on the insulating layer 230. Here, the fourth electrode 510, the output electrode 410, and the fifth electrode 530 contact the distributed electrode 490 via the fourth contact hole 730, the fifth contact hole 750, and the sixth contact hole 770, respectively.

Figure 10:
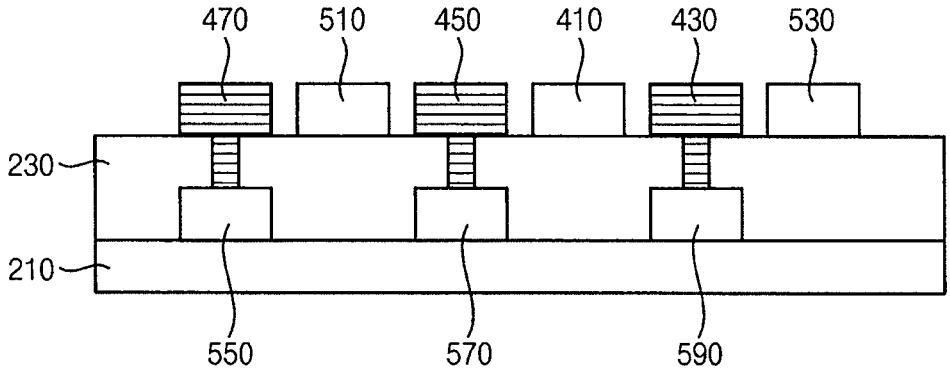
FIG. 10 is a cross-sectional view taken along a line E-E' of FIG. 5.

FIG. 10 is a cross-sectional view taken along a line E-E' of FIG. 5.

Referring to FIGS. 4, 5, and 10, the sixth electrode 550, the seventh electrode 570, and the eighth electrode 590 are formed on the substrate 210. The insulating layer 230 may be formed on the sixth electrode 550, the seventh electrode 570, and the eighth electrode 590. The insulating layer 230 may cover the sixth electrode 550, the seventh electrode 570, and the eighth electrode 590. The third electrode 470, the fourth electrode 510, the second electrode 450, the output electrode 410, the first electrode 430, and the fifth electrode 530 may be formed on the insulating layer 230. Here, the third electrode 470, the second electrode 450, and the first electrode 430 contact the sixth electrode 550, the seventh electrode 570, and the eighth electrode 590 via the seventh contact hole 790, the eighth contact hole 810, and the ninth contact hole 830, respectively.

Figure 11:
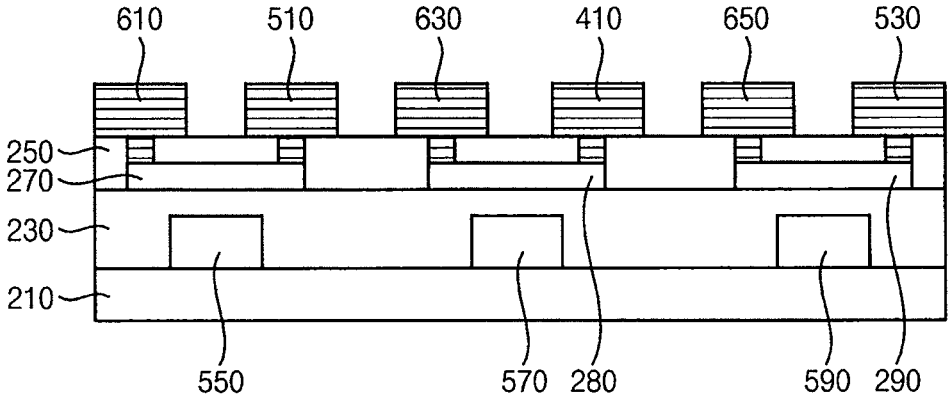
FIG. 11 is a cross-sectional view taken along a line F-F' of FIG. 5.

FIG. 11 is a cross-sectional view taken along a line F-F' of FIG. 5.

Referring to FIGS. 4, 5, and 11, the sixth electrode 550, the seventh electrode 570, and the eighth electrode 590 are formed on the substrate 210. The insulating layer 230 may be formed on the sixth electrode 550, the seventh electrode 570, and the eighth electrode 590. The insulating layer 230 may cover the sixth electrode 550, the seventh electrode 570, and the eighth electrode 590. The first active electrode 270, the second active electrode 280, and the third active electrode 290 may be formed on the insulating layer 230. An insulating interlayer 250 may be formed on the first active electrode 270, the second active electrode 280, and the third active electrode 290. The insulating interlayer 250 may cover the first active electrode 270, the second active electrode 280, and the third active electrode 290. The first data electrode 610, the fourth electrode 510, the second data electrode 630, the output electrode 410, the third data electrode 650, and the fifth electrode 530 may be formed on the insulating interlayer 250.

Here, the first data electrode 610 and the fourth electrode 510 are contacted with the first active electrode 270 via the (10)th contact hole 850 and the (11)th contact hole 870, respectively. The second data electrode 630 and the output electrode 410 are contacted with the second active electrode 280 via the (12)th contact hole 890 and the (13)th contact hole 910, respectively. The third data electrode 650 and the fifth electrode 530 contact the third active electrode 290 via the (14)th contact hole 930 and the (15)th contact hole 950, respectively.

Figure 12:
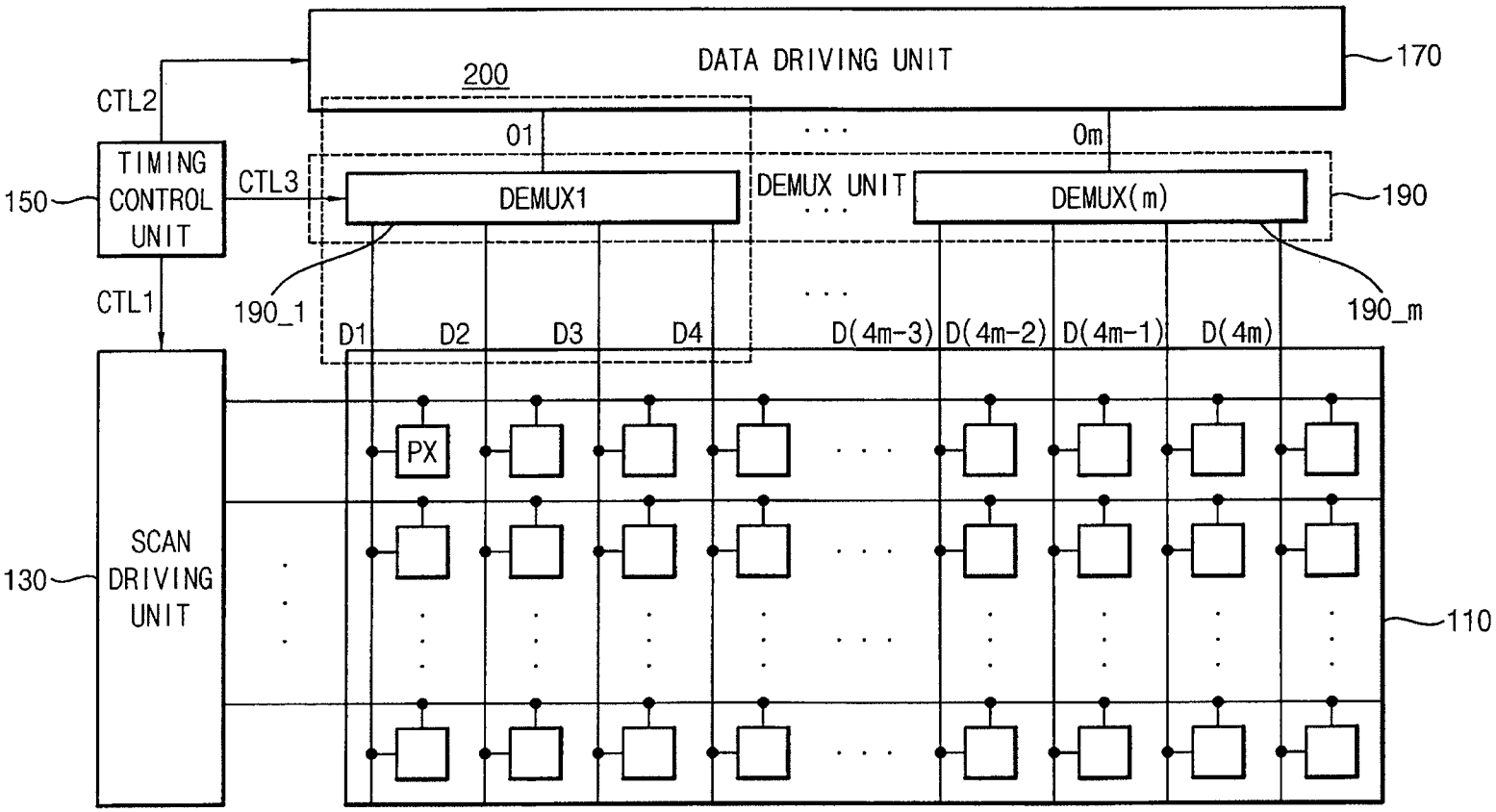
FIG. 12 is a block diagram illustrating an organic light emitting diode display device in accordance with exemplary embodiments.
Figure 13:
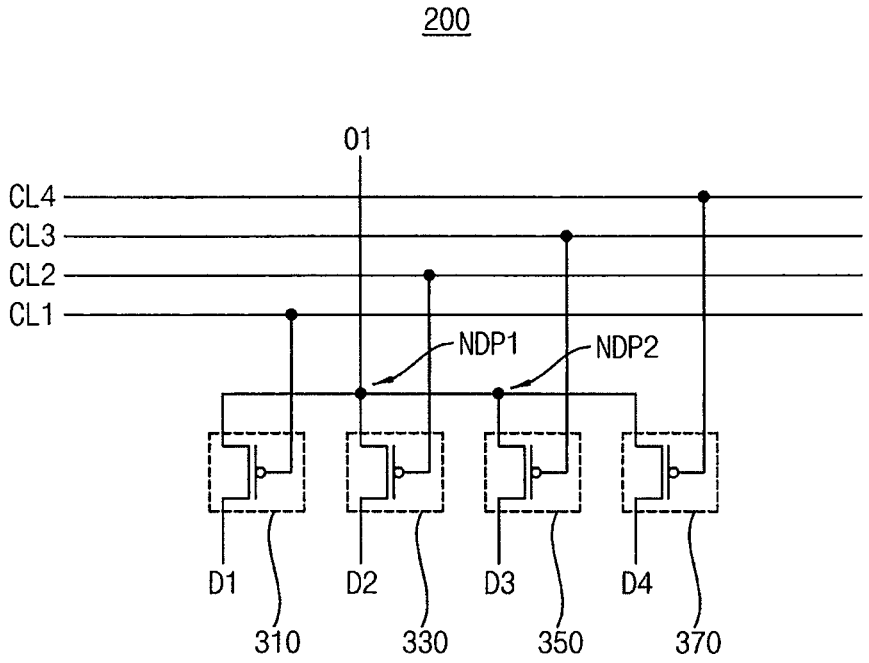
FIG. 13 is a diagram illustrating a demultiplexer included in a demultiplexing unit of the organic light emitting diode display device of FIG. 12.
Figure 14:
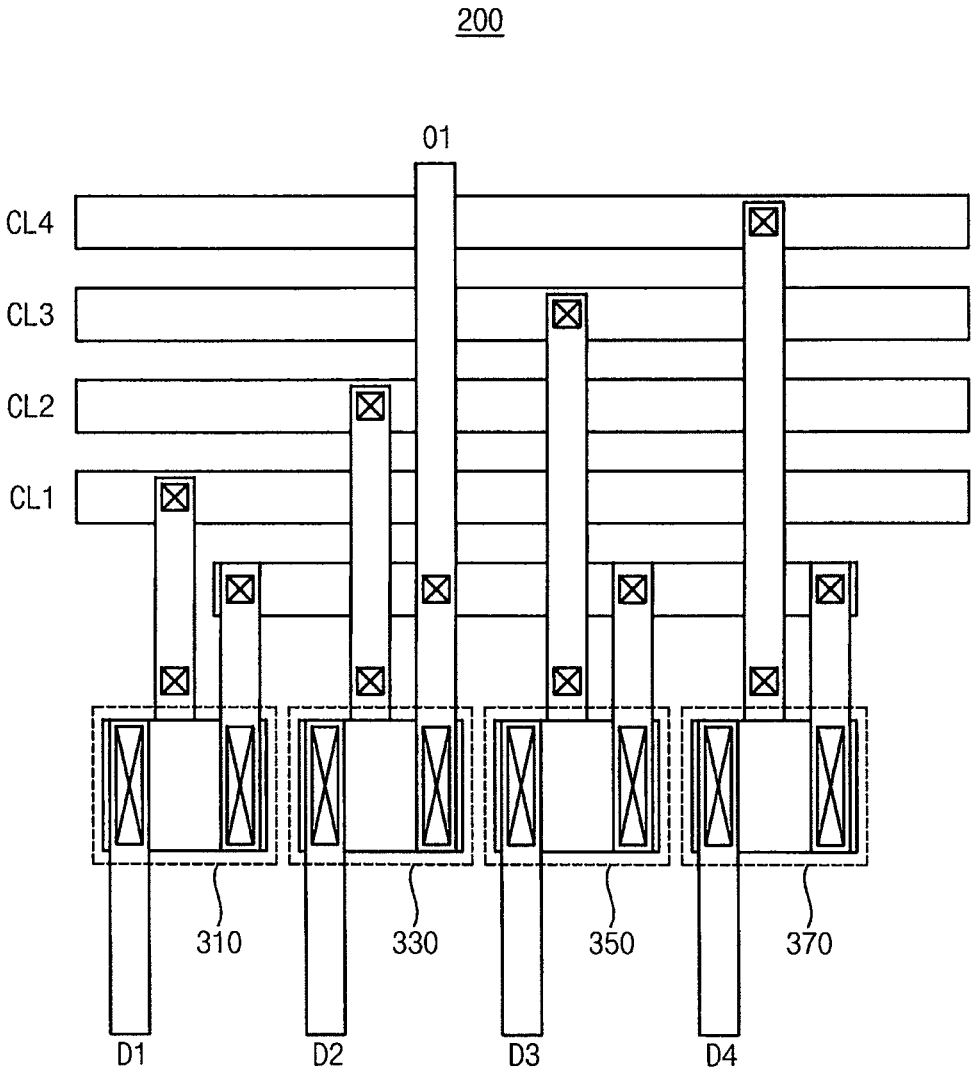
FIG. 14 is a plane view illustrating the demultiplexer of FIG. 13.

FIG. 12 is a block diagram illustrating an organic light emitting diode display device in accordance with exemplary embodiments. FIG. 13 is a diagram illustrating a demultiplexer included in a demultiplexing unit of the organic light emitting diode display device of FIG. 12. FIG. 14 is a plane view illustrating the demultiplexer of FIG. 13.

Referring to FIGS. 12 through 14, the organic light emitting diode display device 2000 includes a display panel 110, a scan driving unit 130, a data driving unit 170, a demultiplexing unit 190, and a timing control unit 150. Here, except that the demultiplexer 200, the organic light emitting diode display device 2000 may have a structure substantially the same as or similar to that of the organic light emitting diode display device 1000 described with reference to FIG. 1. Thus, detailed descriptions for elements, which are substantially the same as or similar to the elements described with reference to FIG. 1 will not be repeated.

The display panel 110 may include a plurality of pixels. The pixels may be arranged at locations corresponding to crossing points of scan-lines SL and data-lines D1 through D(4*m*). In an exemplary embodiment, the display panel 110 may be manufactured based on a WRGB-OLED technology. In one exemplary implementation, a first data signal that is applied to the first data line D1 may be referred to as a red color data signal, and pixels that are connected to the first data line D1 may be referred to as red color pixels. A second data signal that is applied to the second data line D2 may be referred to as a green color data signal, and pixels that are connected to the second data line D2 may be referred to as green color pixels. A third data signal that is applied to the third data line D3 may be referred to as a blue color data signal, and pixels that are connected to the third data line D3 may be referred to as blue color pixels. A fourth data signal that is applied to the fourth data line D4 may be referred to as a white color data signal, and pixels that are connected to the fourth data line D4 may be referred to as white color pixels. However, the present inventive concept is not limited thereto. In one exemplary implementation, according to required conditions for the organic light emitting diode display device 2000, respective color lights emitted by the pixels may be selected among the white color light, the red color light, the green color light, and the blue color light in various ways.

The scan driving unit 130 may sequentially output a scan signal to the display panel 110 in response to a first signal CTL1 of the timing control unit 150. In one exemplary implementation, when the scan signal is outputted to a first scan line SL, the data signals may be applied to the pixels that are coupled to the first scan line SL, respectively. In addition, when the scan signal is outputted to a second scan line SL, the data signals may be applied to the pixels that are coupled to the second scan line SL, respectively.

The data driving unit 170 selectively generates first through fourth data signals in response to a second signal CTL2 of the timing control unit 150. The selected signal is transmitted to demultiplexers 190-1 through 190-m via output lines O1 through Om that are coupled to the demultiplexing unit 190. Depending on operations of the demultiplexing unit 190 based on the second signal CTL2 of the timing control unit 150, the data driver 170 selectively applies the first through fourth data signals to the display panel 110 via the demultiplexing unit 190. In one exemplary implementation, the first data signal corresponds to a signal that is related to the red color pixels emitting the red color light. The second data signal corresponds to a signal that is related to the green color pixels emitting the green color light. The third data signal corresponds to a signal that is related to the blue color pixels emitting the blue color light. The fourth data signal corresponds to a signal that is related to the white color pixels emitting the white color light.

The timing control unit 150 controls the scan driving unit 130, the data driving unit 170, and the demultiplexing unit 190. As illustrated in FIG. 12, the timing control unit 150 generates a first signal CTL1, a second signal CTL2, and a third signal CTL3. Here, the timing control unit 150 controls the scan driving unit 130, the data driving unit 170, and the demultiplexing unit 190 by providing the first signal CTL1, the second signal CTL2, and the third signal CTL3 to the scan driving unit 130, the data driving unit 170, and the demultiplexing unit 190, respectively. Specifically, the timing control unit 150 provides the first signal CTL1 to the scan driving unit 130. Thus, the scan driving unit 130 sequentially outputs the scan signal to the display panel 110. In addition, the timing control unit 150 provides the second signal CTL2 to the data driving unit 170. Thus, the data driving unit 170 outputs the respective data signals corresponding to the pixels of the display panel 110.

Further, the timing control unit 150 provides the third signal CTL3 to the demultiplexing unit 190. Thus, the demultiplexing unit 190 applies or provides the first through fourth data signals. To this end, the third signal CTL3 includes the first through fourth control signals.

As illustrated in FIG. 12, the organic light emitting diode display device 2000 has a demultiplexing structure. Thus, the demultiplexing unit 190 is placed between the display panel 110 and the data driving unit 170. The demultiplexing unit 190 includes a plurality of demultiplexers 190-1 through 190-m. The demultiplexing unit 190 may alternately apply the first through fourth data signals to the pixels, where the first through fourth data signals are alternately outputted from the data driving unit 170.

As illustrated in FIGS. 12 through 14, the demultiplexer 200 includes a first switching element 310, a second switching element 330, a third switching element 350, and a fourth switching element 370.

A first terminal of the first switching element 310 is coupled to a first branch point NDP1 of the output line O1 of the data driving unit 170. In addition, a second terminal of the first switching element 310 is coupled to the first data line D1. Further, a gate terminal of the first switching element 310 is coupled to the first control signal line CL1 of the timing control unit 150.

A first terminal of the second switching element 330 is coupled to the first branch point NDP1. A second terminal of the second switching element 330 is coupled to the second data line D2. A gate terminal of the second switching element 330 is coupled to the second control signal line CL2 of the timing control unit 150.

A first terminal of the third switching element 350 is coupled to a second branch point NDP2. A second terminal of the third switching element 350 is coupled to the third data line D3. A gate terminal of the third switching element 350 is coupled to the third control signal line CL3 of the timing control unit 150.

A first terminal of the fourth switching element 370 is coupled to the first branch point NDP1. A second terminal of the fourth switching element 370 is coupled to the fourth data line D4. A gate terminal of the fourth switching element 370 is coupled to the fourth control signal line CL4 of the timing control unit 150.

In one exemplary implementation, at least one of the first, second, third or fourth data lines D1-D4 does not cross over or overlaps the first, second, third, and fourth control signal lines CL1-CL4. In another exemplary implementation, all the first, second, third, and fourth data lines D1-D4 do not cross over or overlap the first, second, third, and fourth control signal lines CL1-CL4.

The first through fourth switching elements 310, 330, 350, and 370 are formed closer to the display panel 110 than the first through fourth control signal lines CL1-CL4. The first and second branch point NDP1, 2 are formed between the first through fourth control signal lines CL1-CL4, and the first through fourth switching elements 310, 330, 350, 370.

In this case, since the first through fourth data lines D1-D4 may not be formed over the first through fourth control signal lines CL1-CL4, an overlap capacitance of the demultiplexer 200 may be reduced compared to an overlap capacitance of the conventional demultiplexer. As a result, an image quality of the display panel 110 may be improved.

The present inventive concept may be applied to any electronic device that includes an organic light emitting diode display device having a demultiplexing structure. In one exemplary implementation, the present inventive concept may be applied to a television, a mobile phone, a smart phone, a laptop, a tablet, a computer, a personal digital assistant (PDA), a portable multimedia player (PMP), a digital camera, a music player (e.g., MP3 player), a portable game console, a navigation system, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. An organic light emitting diode (OLED) display device, comprising:

a display panel;

a scan driver;

a data driver including an output line;

a demultiplexing unit including a plurality of demultiplexers; and a timing controller including first, second and third control signal lines, wherein each demultiplexer comprises:

a first switching element including a first terminal coupled to a branch point of the output line, a second terminal coupled to a first data line, and a gate terminal coupled to the first control signal line;

a second switching element including a first terminal coupled to the branch point, a second terminal coupled to a second data line, and a gate terminal coupled to the second control signal line; and a third switching element including a first terminal coupled to the branch point, a second terminal coupled to a third data line, and a gate terminal coupled to the third control signal line, wherein the first to third switching elements are arranged in a first direction, wherein the first to third control lines are located between the data driver and the branch point and extend in the first direction, wherein the first to third control lines are respectively connected to the first to third switching elements via first to third connecting lines that extend in a second direction crossing the first direction, wherein the distance between the group of the first through third switching elements and the display panel is less than the distance between the group of the first through third switching elements and the group of the first through third control signal lines, and wherein the branch point is formed between the group of the first through third control signal lines and the group of the first through third switching elements.

2. The device of claim 1, wherein the first control signal line comprises a first control signal electrode, wherein the second control signal line comprises a second control signal electrode, wherein the third control signal line comprises a third control signal electrode, wherein the first data line comprises a first data electrode, wherein the second data line comprises a second data electrode, wherein the third data line comprises a third data electrode, wherein the branch point comprises a distributed electrode, and wherein the output line comprises an output electrode.

3. The device of claim 2, wherein the first through third switching elements correspond to p-channel metal oxide semiconductor (PMOS) transistors, and wherein the first terminal corresponds to a source electrode, wherein the second terminal corresponds to a drain electrode, and wherein the gate terminal corresponds to a gate electrode.

4. The device of claim 3, wherein the distributed electrode is formed between the first through third control signal electrodes and the first through third switching elements, and wherein the distributed electrode is contacted with the output electrode.

5. The device of claim 3, wherein the output electrode is connected to the source electrodes of the first through third switching elements via the distributed electrode.

6. The device of claim 3, wherein the drain electrode of the first switching element is connected to the first data electrode, wherein the drain electrode of the second switching element is connected to the second data electrode, and wherein the drain electrode of the third switching element is connected to the third data electrode.

7. The device of claim 3, wherein the gate electrode of the first switching element is connected to the first control signal electrode, wherein the gate electrode of the second switching element is connected to the second control signal electrode, and wherein the gate electrode of the third switching element is connected to the third control signal electrode.

8. The device of claim 3, wherein the display panel is manufactured based on an RGB-OLED technology.

9. The device of claim 8, wherein the first control signal is configured to control a switching operation of the first switching element, wherein the second control signal is configured to control a switching operation of the second switching element, and wherein the third control signal is configured to control a switching operation of the third switching element.

10. The device of claim 9, wherein the first switching element is configured to apply a red color data signal that is outputted at the data driver to a red color pixel of the display panel, wherein the second switching element is configured to apply a green color data signal that is outputted at the data driver to a green color pixel of the display panel, and wherein the third switching element is configured to apply a blue color data signal that is outputted at the data driver to a blue color pixel of the display panel.

11. The device of claim 1, wherein the shortest distance between one of the first through third switching elements and the display panel is less than the shortest distance between the first through third control signal lines and the display panel.

12. An organic light emitting diode (OLED) display device comprising:

a display panel;

a scan driver;

a data driver including an output line;

a demultiplexing unit including a plurality of demultiplexers; and a timing controller including first, second, third and fourth control signal lines, wherein each demultiplexer comprises:

a first switching element including a first terminal coupled to a first branch point of the output line, a second terminal coupled to a first data line, a gate terminal coupled to the first control signal line;

a second switching element including a first terminal coupled to the first branch point, a second terminal coupled to a second data line, and a gate terminal coupled to the second control signal line;

a third switching element including a first terminal coupled to a second branch point, a second terminal coupled to a third data line, and a gate terminal being coupled to the third control signal line; and a fourth switching element including a first terminal coupled to the first branch point, a second terminal coupled to a fourth data line, and a gate terminal coupled to the fourth control signal line, wherein the first to fourth switching elements are arranged in a first direction, wherein the first to fourth control lines are located between the data driver and the branch point and extend in the first direction, wherein the first to fourth control lines are respectively connected to the first to fourth switching elements via first to fourth connecting lines that extend in a second direction crossing the first direction, wherein the first through fourth switching elements are formed closer to the display panel than the first through fourth control signal lines, and wherein the first and second branch points are formed between the group of the first through fourth control signal lines and the group of the first through fourth switching elements.

13. The device of claim 12, wherein the first control signal line comprises a first control signal electrode, wherein the second control signal line comprises a second control signal electrode, wherein the third control signal line comprises a third control signal electrode, wherein the fourth control signal line comprises a fourth control signal electrode, wherein the first data line comprises a first data electrode, wherein the second data line comprises a second data electrode, wherein the third data line comprises a third data electrode, wherein the fourth data line comprises a fourth data electrode, wherein, the first and second branch points are implemented by a distributed electrode, and wherein the output line comprises an output electrode.

14. The device of claim 13, wherein the first through fourth switching elements correspond to p-channel metal oxide semiconductor transistors, wherein the first terminal corresponds to a source electrode, wherein the second terminal corresponds to a drain electrode, and wherein the gate terminal corresponds to a gate electrode.

15. The device of claim 14, wherein the distributed electrode is formed between the first through fourth control signal electrodes and the first through fourth switching elements, wherein the distributed electrode is contacted with the output electrode, and wherein the output electrode is connected to the source electrodes of the first through fourth switching elements via the distributed electrode.

16. The device of claim 14, wherein the drain electrode of the first switching element is connected to the first data electrode, wherein the drain electrode of the second switching element is connected to the second data electrode, wherein the drain electrode of the third switching element is connected to the third data electrode, and wherein the drain electrode of the fourth switching element is connected to the third data electrode.

17. The device of claim 14, wherein the gate electrode of the first switching element is connected to the first control signal electrode, wherein the gate electrode of the second switching element is connected to the second control signal electrode, wherein the gate electrode of the third switching element is connected to the third control signal electrode, and wherein the gate electrode of the fourth switching element is connected to the fourth control signal electrode.

18. The device of claim 14, wherein the display panel is manufactured based on a WRGB-OLED technology.

19. The device of claim 18, wherein the first control signal is configured to control a switching operation of the first switching element, wherein the second control signal is configured to control a switching operation of the second switching element, wherein the third control signal is configured to control a switching operation of the third switching element, and wherein the fourth control signal is configured to control a switching operation of the fourth switching element.

20. The device of claim 19, wherein the first switching element is configured to apply a red color data signal that is outputted at the data driver to a red color pixel of the display panel, wherein the second switching element is configured to apply a green color data signal that is outputted at the data driver to a green color pixel of the display panel, wherein the third switching element is configured to apply a blue color data signal that is outputted at the data driver to a blue color pixel of the display panel, and wherein the fourth switching element is configured to apply a white color data signal that is outputted at the data driver to a white color pixel of the display panel.

21. An organic light emitting diode (OLED) display device, comprising:

a display panel;

a data driver including an output line;

a timing controller including first, second and third control signal lines; and a plurality of demultiplexers each including:

a first switching element including a first terminal coupled to a branch point of the output line, a second terminal coupled to a first data line, and a gate terminal coupled to the first control signal line;

a second switching element including a first terminal coupled to the branch point, a second terminal coupled to a second data line, and a gate terminal coupled to the second control signal line; and a third switching element including a first terminal coupled to the branch point, a second terminal coupled to a third data line, and a gate terminal coupled to the third control signal line, wherein the first to third switching elements are arranged in a first direction, wherein the first to third control lines are located between the data driver and the branch point and extend in the first direction, wherein the first to third control lines are respectively connected to the first to third switching elements via first to third connecting lines that extend in a second direction crossing the first direction, wherein at least one of the first, second or third data lines does not cross over or overlap the first, second and third control signal lines, and wherein the branch point is formed between the group of the first through third control signal lines and the group of the first through third switching elements.

* * * * *